US008313579B2

(12) United States Patent
Cruz et al.

(10) Patent No.: US 8,313,579 B2
(45) Date of Patent: Nov. 20, 2012

(54) WORKPIECE CLEANING

(75) Inventors: Dennis Quinto Cruz, Longmont, CO (US); David Maxwell Harrold, Longmont, CO (US); Grant Nicholas Hester, Longmont, CO (US); Timothy Ronald Brown, Westminster, CO (US)

(73) Assignee: Seagate Technology LLC, Cupertino, CA (US)

( * ) Notice: Subject to any disclaimer, the term of this patent is extended or adjusted under 35 U.S.C. 154(b) by 436 days.

(21) Appl. No.: 12/617,452

(22) Filed: Nov. 12, 2009

(65) Prior Publication Data

US 2011/0108071 A1 May 12, 2011

(51) Int. Cl.
*B08B 7/04* (2006.01)
*B08B 7/00* (2006.01)

(52) U.S. Cl. ..... 134/18; 134/1; 134/33; 134/34; 134/37; 134/56 R; 134/57 R; 134/58 R; 134/172; 134/182; 134/198; 15/300.1; 15/319; 15/320; 15/345; 15/405

(58) Field of Classification Search ..... 134/1, 18, 134/32, 33, 34, 37, 56 R, 57 R, 58 R, 172, 134/182, 198; 15/300.1, 319, 320, 345, 405
See application file for complete search history.

(56) References Cited

U.S. PATENT DOCUMENTS

| | | | | |
|---|---|---|---|---|
| 3,731,291 | A | 5/1973 | Walsh | |
| 3,846,835 | A | 11/1974 | Horovitz et al. | |
| 4,171,754 | A * | 10/1979 | Rosado | 222/646 |
| 4,920,465 | A * | 4/1990 | Sargent | 362/96 |
| 5,649,556 | A * | 7/1997 | Braun | 134/92 |
| 6,181,039 | B1 | 1/2001 | Kennedy et al. | |
| 7,016,145 | B2 | 3/2006 | Gunderson et al. | |
| 7,134,946 | B1 | 11/2006 | Jackson | |
| 7,293,570 | B2 | 11/2007 | Jackson | |
| 7,298,571 | B1 | 11/2007 | Schmidt | |
| 7,389,941 | B2 | 6/2008 | Jackson | |
| 7,751,188 | B1 * | 7/2010 | French et al. | 361/691 |
| 2005/0126610 | A1 * | 6/2005 | Hoser | 134/95.2 |
| 2005/0168945 | A1 * | 8/2005 | Coglitore | 361/695 |
| 2005/0274402 | A1 * | 12/2005 | Saito et al. | 134/103.1 |
| 2006/0123801 | A1 | 6/2006 | Jackson | |
| 2007/0114488 | A1 | 5/2007 | Jackson | |
| 2008/0210271 | A1 * | 9/2008 | Chasen et al. | 134/111 |

* cited by examiner

*Primary Examiner* — Alexander Markoff
(74) *Attorney, Agent, or Firm* — Mitchell K. McCarthy; McCarthy Law Group

(57) ABSTRACT

An apparatus and associated method are provided for treating a workpiece with a cryogenic impingement fluid. A fixture supports the workpiece in an upright position and operably connects an electrical component of the workpiece to a power source in the supported position. A cryogenic impingement fluid applicator sprays a stream of the cryogenic impingement fluid against the supported workpiece and laterally moves the stream in accordance with a predetermined path. A shield deflects the stream of cryogenic impingement fluid to prevent the stream from contacting at least a part of the workpiece as the stream is moved along the predetermined path.

20 Claims, 8 Drawing Sheets

WORKPIECE CLEANING

SUMMARY

In some embodiments an apparatus is provided for processing a motor-base assembly (MBA). The apparatus includes a fixture defining a support feature sized for removably supporting the MBA. A power source is supported by the fixture and is operably aligned with the supported MBA to supply electrical power to a motor of the MBA. The apparatus includes a processing fluid source, and a nozzle coupled to the processing fluid source that defines an outlet sized for emitting a stream of the processing fluid from the nozzle to impact against the supported MBA with a desired impact force. A nozzle mover moves the nozzle in order to laterally move the stream of emitted processing fluid along a predetermined path. A shield deflects the emitted stream of processing fluid away from at least a part of the supported MBA as the stream is moved along the predetermined path.

In some embodiments a method is provided for processing an MBA, including the steps of: removably supporting the MBA in a fixture that operably connects a motor of the MBA to a power source; energizing the motor via the power source to rotate the motor at a controlled operational speed; during the energizing step, laterally moving a nozzle coupled to a processing fluid source along a predetermined path so that a stream of the processing fluid emitted from the nozzle impacts against the supported MBA with a desired impact force along the predetermined path; and deflecting the stream of the emitted processing fluid away from at least a part of the supported MBA as the stream is moved along the predetermined path.

In some embodiments an apparatus is provided for treating a workpiece with a cryogenic impingement fluid that includes a fixture that supports the workpiece in an upright position and operably connects a motor of the workpiece to a power source in the supported position. A cryogenic impingement fluid applicator sprays a stream of the cryogenic impingement fluid against the supported workpiece and laterally moves the stream in accordance with a predetermined path. A shield deflects the stream of cryogenic impingement fluid to prevent the stream from contacting at least a part of the workpiece as the stream is moved along the predetermined path.

DESCRIPTION

Figure 1:
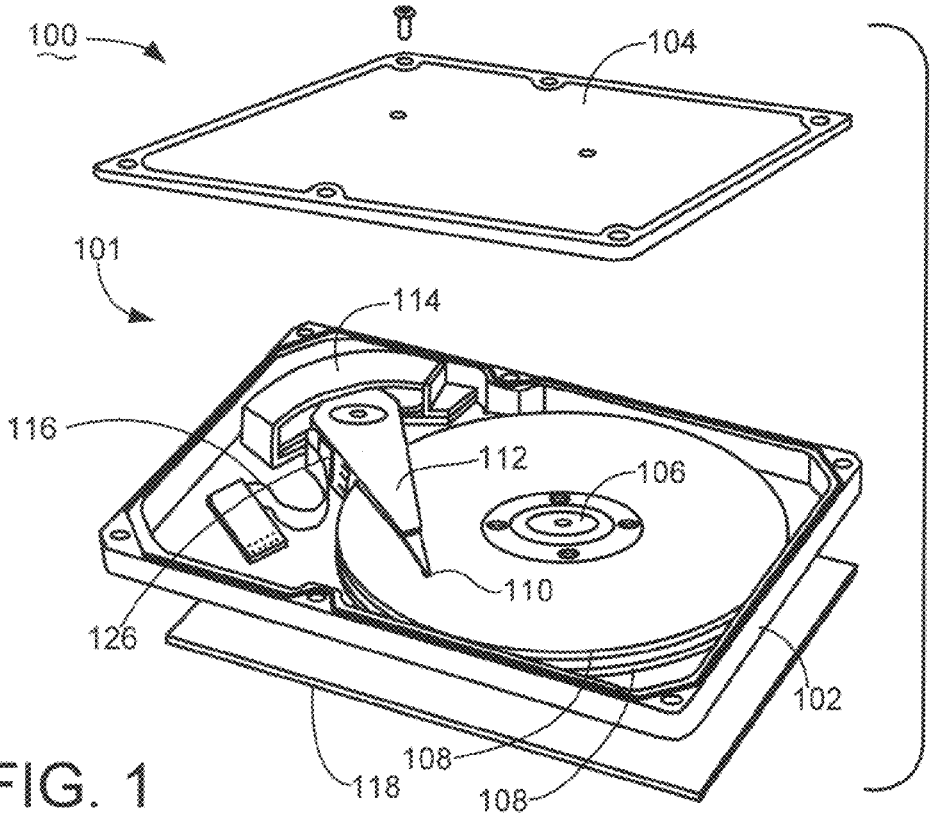
FIG. 1 is an isometric depiction of a data storage device that is suited for use as a workpiece with the present embodiments.

The embodiments of the present invention are generally directed to environmentally safe processes for removing contaminants, such as organic films or particulates, from workpieces during manufacturing or rework/repair operations. The use of harsh cleaning chemicals like trichloroethylene can be avoided by instead using environmentally safe cryogenic impingement fluids, such as solid phase carbon dioxide sprays.

In such a system liquid carbon dioxide is condensed to form solid carbon dioxide particles, commonly called dry ice snow particles. The snow particles are carried by a propellant gas stream to produce a stream with an adequate volume and velocity to dislodge and sweep away the contaminants from the workpiece. The residual snow particles evaporate as they are warmed by the ambient temperature, leaving no trace moisture or other contamination concerns.

The science behind making the snow particles favors employing a continuous flow process with a flow rate that is not constantly being switched on and off or being significantly varied. For example, in some systems the liquid carbon dioxide is fed to a small diameter tube. The liquid carbon dioxide eventually exits the small diameter tube and enters a relatively larger diameter tube which causes the liquid carbon dioxide to solidify into the snow particles in the fluid stream. It is necessary to subject the snow particles to the propellant gas stream as they form mid-stream in order to achieve the desired granular consistency. Thus, to achieve the desired effective flow of cryogenic impingement fluid, a steady state flow of liquid carbon dioxide to the small diameter tube is required. However, that steady state condition runs counter many times to the need to shut off or reduce the flow of the cryogenic impingement fluid, such as to protect a sensitive part of the workpiece from the impingement force (sometimes also referred to as "impact force") of the fluid stream.

It has also been observed that the localized high pressure of the stream of cryogenic impingement materials impacting against the workpiece can adversely drive the contaminants into joints and crevices in the workpiece instead of sweeping them away. Complex nozzle directing and positioning schemes in attempts to guide the contaminants away from such traps can have the deleterious effect of reducing the workpiece processing throughput rate.

In view of the foregoing, the embodiments of the present invention are directed to an apparatus and an associated method fir cleaning contaminants from a workpiece. The embodiments employ an environmentally safe cryogenic impingement fluid in doing so, such as using liquid carbon dioxide to form a stream of snow particles that is aimed against the workpiece. Although an illustrative workpiece in the following description is a motor-base assembly in a disc drive data storage device, the present embodiments are not so limited. The skilled artisan having read the description can readily adapt the apparatus and associated method of the claimed embodiments for use with other workpieces, such that an enumeration of all contemplated workpieces suited for use with the claimed invention is not necessary for the skilled artisan to understand the scope of the claimed embodiments.

FIG. 1 depicts an exploded isometric view of a data storage device 100 of the type used to magnetically store and retrieve computerized data. The device 100 includes a sealable housing 101 formed by joining a base 102 to a cover 104.

The housing 101 provides a controlled interior environment for various constituent components of the device 100, including a spindle motor 106 used to rotate one or more data storage media 108. Two such media 108 are shown in the form of axially aligned magnetic recording discs.

Data are stored to and retrieved from the media 108 by an array of data transducing heads 110. The heads 110 (also referred to as "data transducers") are supported by a rotary actuator 112 and moved across the media surfaces by a voice coil motor (VCM) 114.

A flex circuit 116 establishes electrical communication paths between the actuator 112 and control circuitry on a printed circuit board (PCB) 118 mounted to the underside of the base 102.

The cleanliness inside the housing 101 is a paramount concern. That is, the data transducers 110 have aerodynamic features that cause them to be lifted away from the respective media 108 as a result of fluidic forces created by spinning the media 108. The operable spacing between each data transducer 110 and its respective media 108 is likely to be less than the size of contamination particles that might migrate into or otherwise be present in the housing 101, such as dust particles or magnetic coating particles created by an incidental contact between a data transducer 110 and the media 108. For this reason, assembling components to the base 102 and assembling the base 102 and cover 104 together are operations that are conducted in cleanroom conditions to prevent the occurrence of contaminating the housing 101.

Figure 2:
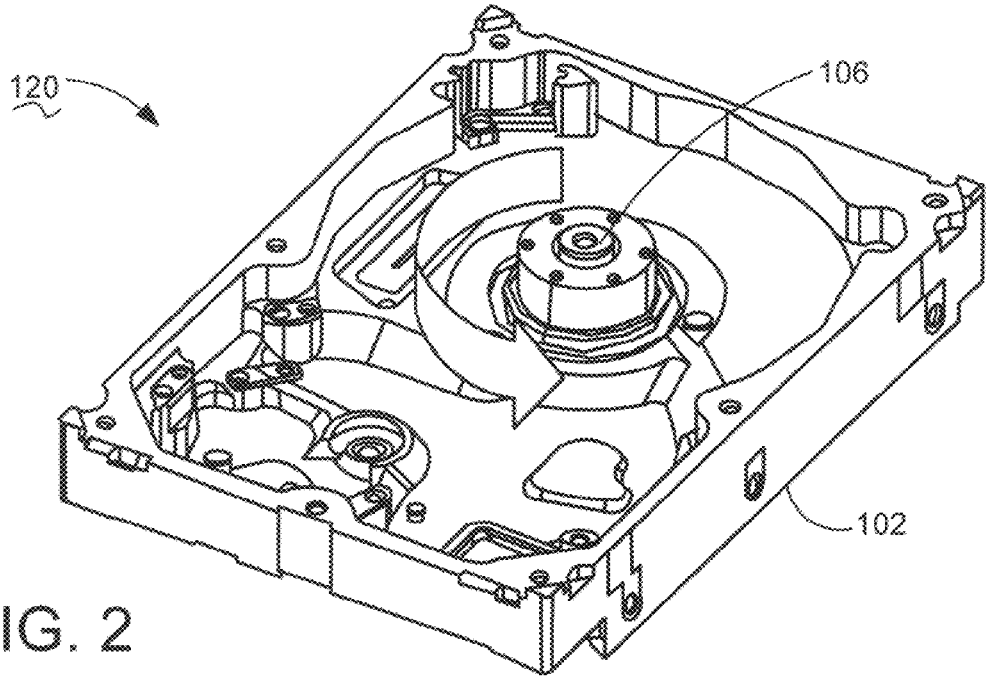
FIG. 2 is an isometric depiction of the motor-base assembly (MBA) of the data storage device in FIG. 1.

However, there are routine occurrences when the assembled housing 101 has to be reopened after having been sealed, such as during rework or repair of a data storage device 100. Often times the determination is made to scrap damaged or defective media 108 in a reworked or repaired data storage device 100, but to salvage the motor 106 and base 102 because they are in fit for use condition and to scrap them would be an unnecessary expense. FIG. 2 depicts the subassembly consisting of the motor 106 attached to the base 102 that is referred to herein as the motor-base assembly ("MBA") 120.

The teardown operations that yield a salvaged MBA 120 are typically not performed in cleanroom conditions. Therefore, any contamination on the MBA 120 created by the failure condition in the data storage device 100 and any contamination introduced by teardown operations must be cleaned from the MBA 120 before it can be assembled into a new data storage device 100.

Figure 3:
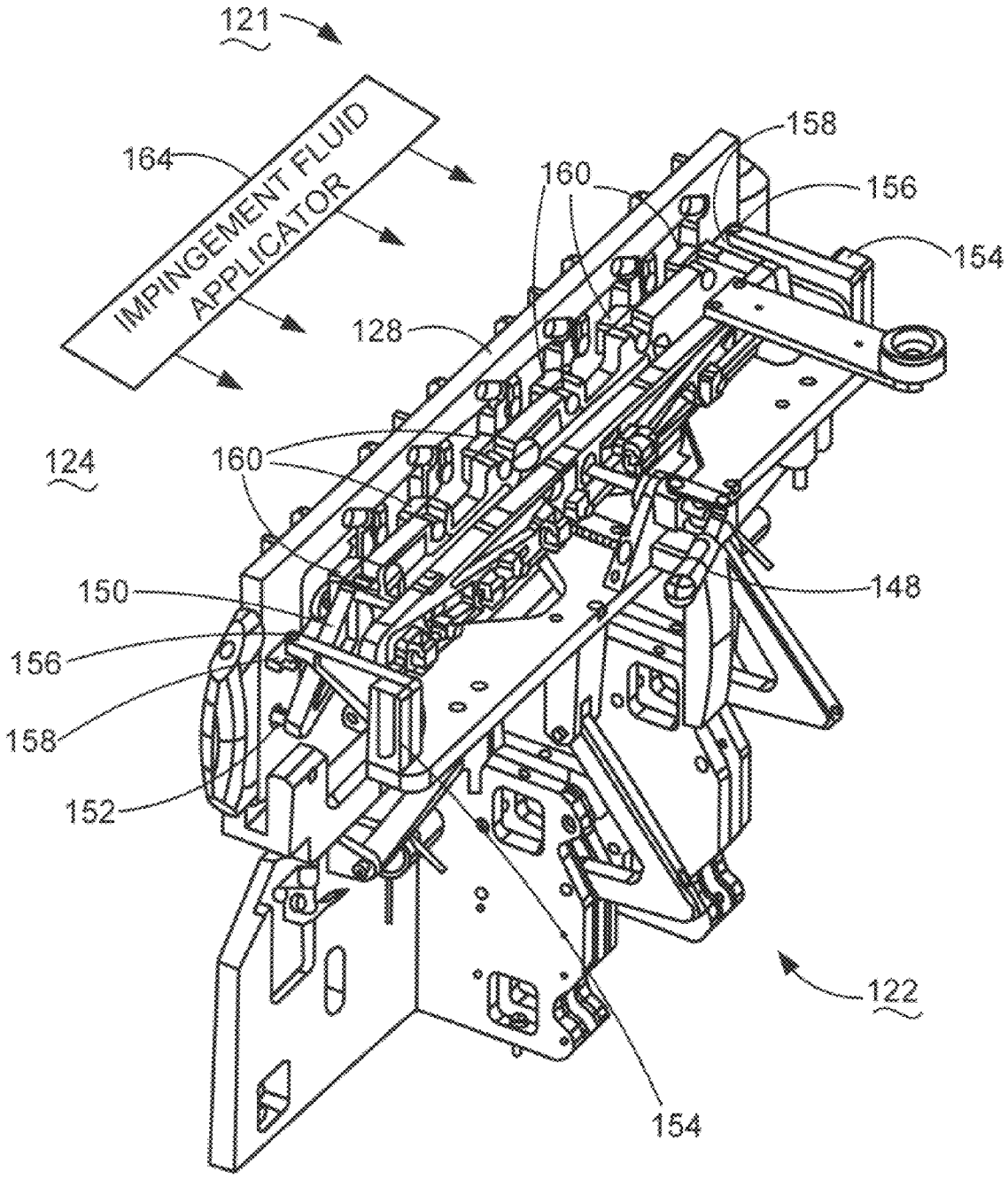
FIG. 3 is an isometric depiction of a fixture constructed in accordance with the present embodiments.
Figure 4:
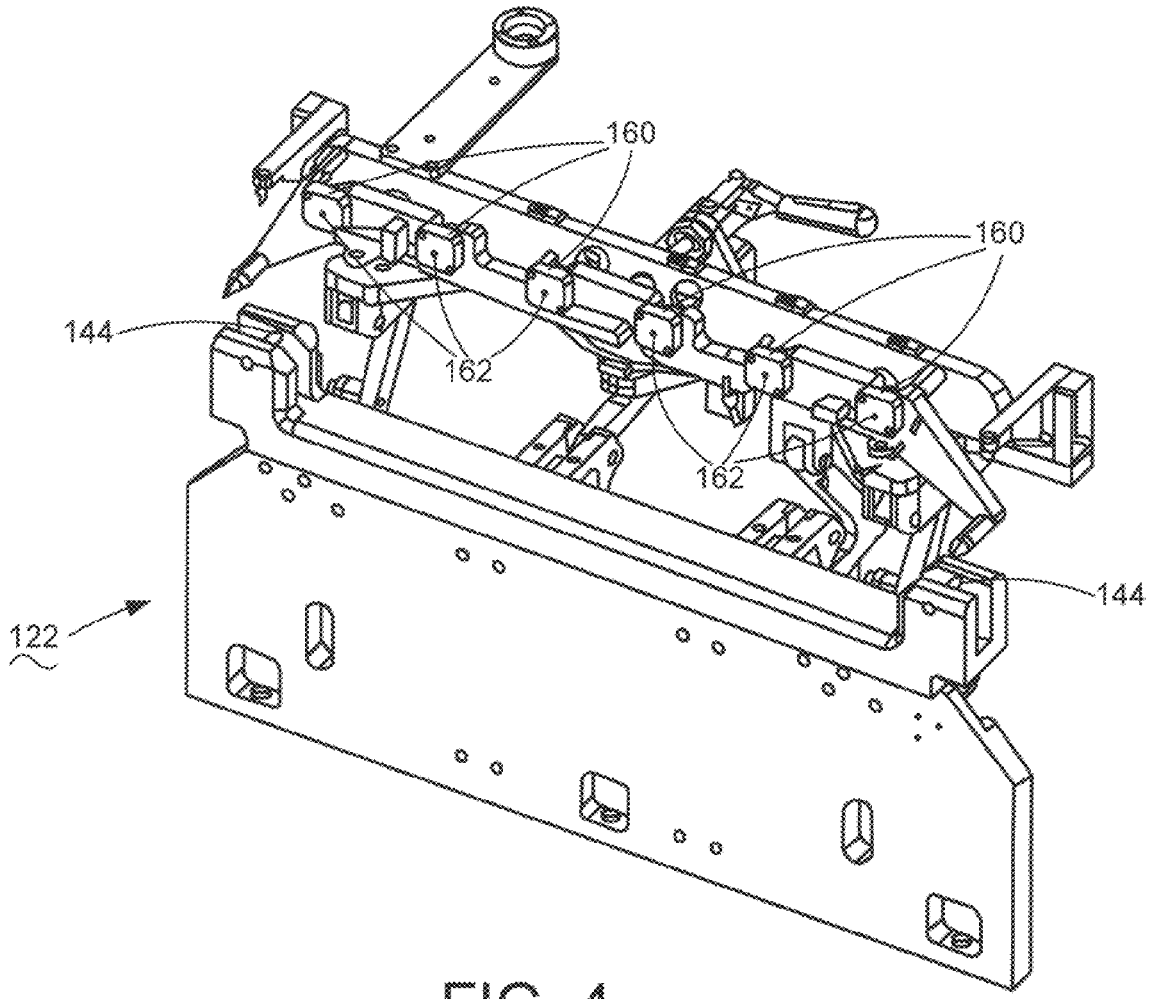
FIG. 4 is an enlarged detail of a portion of the fixture of FIG. 3 with the nest block removed.
Figure 5:
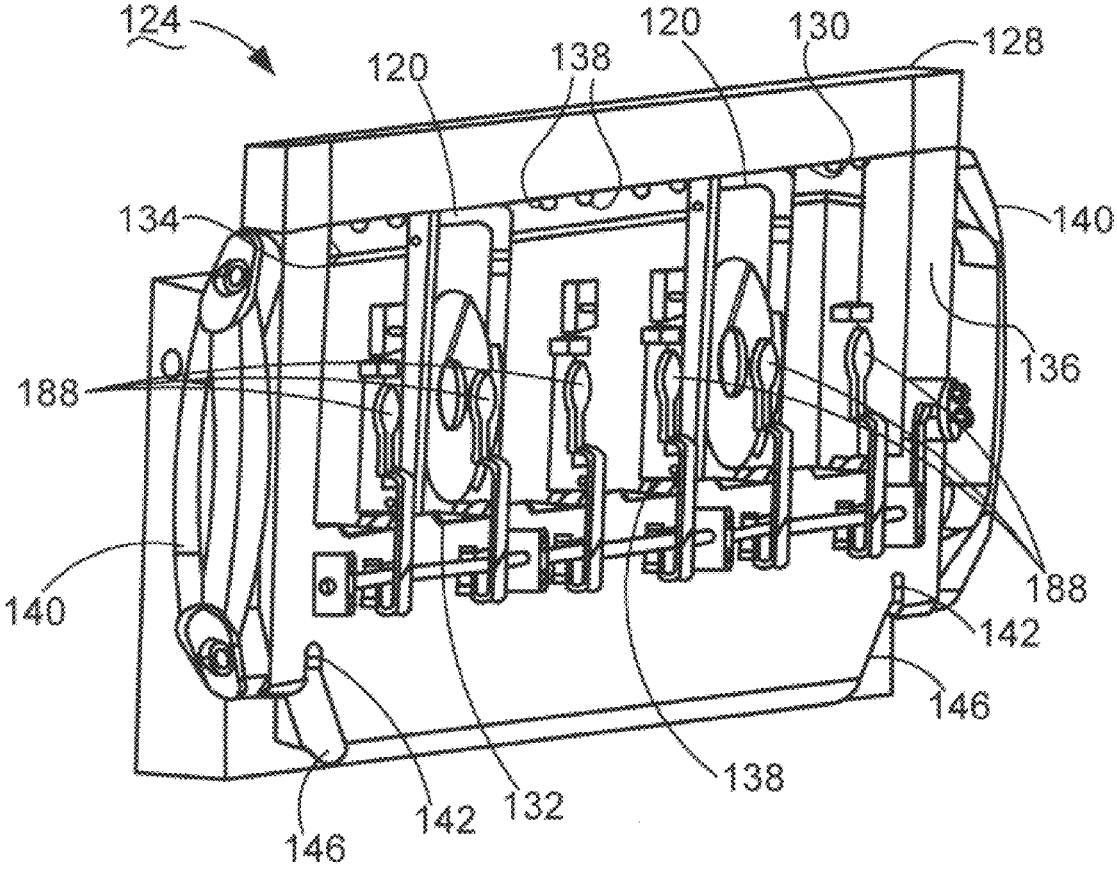
FIG. 5 is an isometric depiction of the nest block with two MBAs loaded to it.

FIG. 3 is an isometric depiction of an illustrative apparatus for processing an MBA 120 for that purpose in accordance with embodiments of the present invention. A fixture 121 generally has a stationary framework 122 and a removable nest block 124. FIG. 4 depicts a portion of the framework 122 from another perspective with the nest block 124 having been removed (nest block 124 not depicted in FIG. 4). FIG. 5 depicts the nest block 124 having been removed from the framework 122 (framework 122 not depicted in FIG. 5).

Staying focused on FIGS. 3-5, in these embodiments the nest block 124 has a frame 128 defining horizontal opposing surfaces 130, 132 and vertical opposing surfaces 134, 136 forming an opening sized to accommodate six MBAs 120 at once, although only two MBAs 120 are shown attached to the nest block 124 in FIG. 5. Protuberant members 138 can project into the opening against which the MBAs 120 are abuttingly engaged to positively locate them in the opening depth wise. Other protuberant features of the frame 128 (not depicted) can matingly engage features of the base 102, such as corners of the base 102, to positively locate the MBAs 120 in the opening laterally. Once positioned in the opening, the MBAs 120 can be retained there in any of a number of ways such as by using clamps, latches, compression members, and the like (not depicted). After attaching the bases 102 to the frame 128, the nest block 124 and attached MBAs 120 are unitarily removably attachable to the framework 122 for processing purposes.

Using two or more of the removable nest blocks 124 during processing advantageously permits a set of MBAs 120 in a first nest block 124 to be attached to the framework 122 for processing while one or more other nest blocks 124 are having MBAs 120 loaded and/or unloaded to them. Shuttling a number of nest blocks 124 in that manner generally tends to improve the utilization of the apparatus 121 with regard to the cleaning process it is used to perform. A pair of handles 140 are attached to the frame 128 to aid in handling the nest blocks 124 during the shuttling, either manually or by automated systems.

The frame 128 also defines a pair of notches 142 that matingly engage a pair of pins 144 (FIG. 4) to positively locate the nest block 124 on the framework 122. Chamfered surfaces 146 leading to each of the notches 142 guide the pins 144 (FIG. 4) into the notches 142.

Focusing now on FIG. 3, the framework 122 features a 4-bar mechanism that allows easy nest block 124 replacement when lowered, and that positions a support plate 150 adjacent to the nest block 124 when raised. The 4-bar mechanism also allows the support plate 150 to remain in the lowered position while the pins 144 (FIG. 4) can be clearingly rotated to allow the opposite side of the MBA (or other part) to be cleaned when power to the motor (discussed below) is not required. Once the nest block 124 is in place, a clamp lever 148 can be articulated to move the support plate 150 toward the nest block 124. The clamp lever 148 can be activated manually, or alternatively it or an equivalent mechanism can be activated by an automated system to move the support plate 150.

The support plate 150 has a pair of precision locating pins 152 (only one depicted) on opposing ends thereof that insert horizontally into mating bushings machined into the frame 128 to align the support plate 150 to the frame. The support plate 150 self-aligns to the nest block 124 as the locating pins 152 engage the bushings. For additional support a pair of vertical actuators 154 can lower another pair of precision pins 156 to insert them vertically into mating bushings 158 mounted on opposing ends of the frame 128.

The support plate 150 portion of the framework 122 also supports a like number of modular pin blocks 160 that are moved toward the nest block 124 by the activation of the clamp lever 148 discussed above. FIG. 4 shows each of the pin blocks 160 supports a terminal end of an electrical power source in the form of a pattern of protuberant electrical connection pins 162, such as but not limited to Pogo® pins. The pins 162 are sized and spatially arranged to matingly engage an electrical connector of the motor 106 in the associated supported MBA 120. The sets of pins 162 are all connected to a voltage supply (not depicted) that is controllable to energize all the motors 106 simultaneously to a controlled operational speed during processing of the workpieces. The pin blocks 160 are modularly constructed in that they are each removably attached by a pair of threaded fasteners that engage the support plate 150, making existing pin blocks readily replaceable with other pin blocks having a differently configured set of pins 162.

Figure 6:
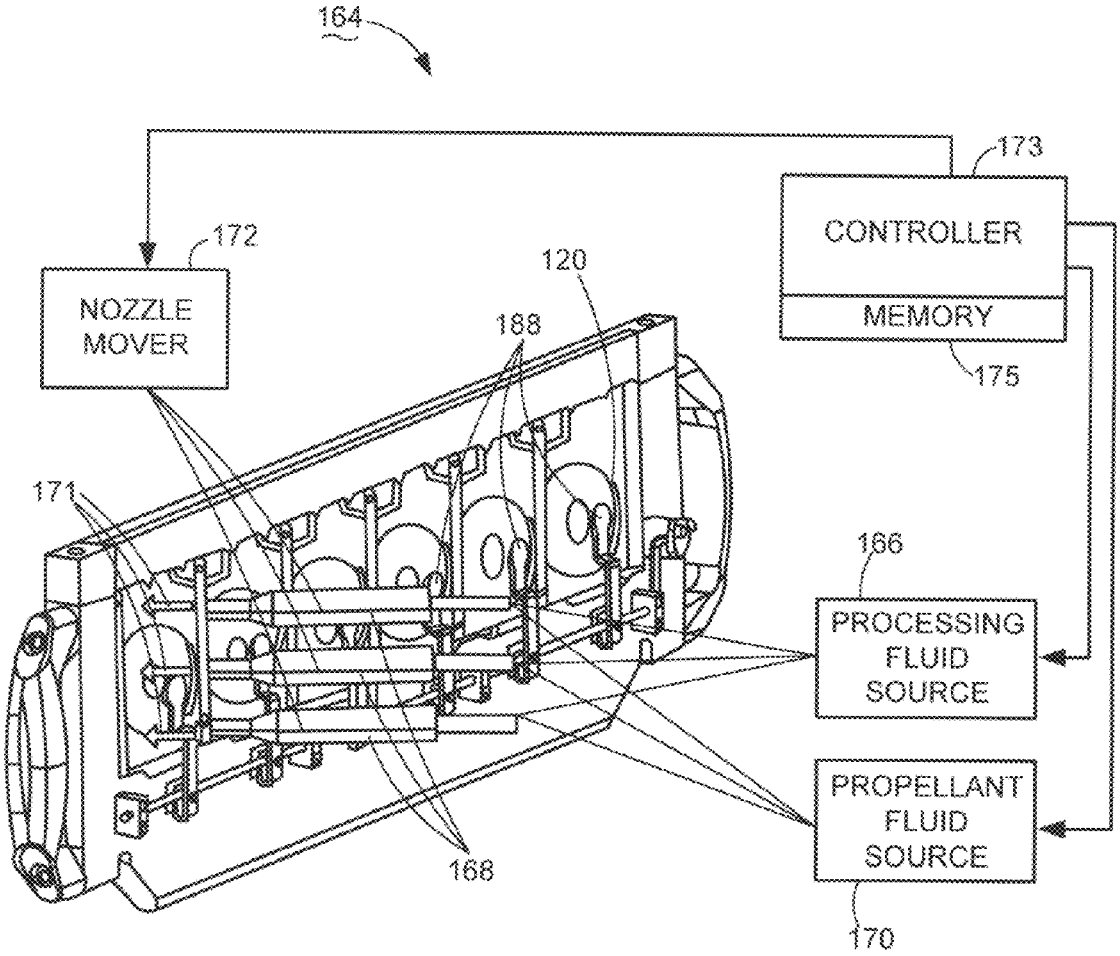
FIG. 6 is an isometric depiction of a fully loaded nest block and functional block diagram of the impingement fluid applicator of the present embodiments.

Returning momentarily to FIG. 3, which diagrammatically depicts an impingement fluid applicator 164 selectively directing an impingement fluid against the upright MBAs 120 supported in the apparatus 121. FIG. 6 depicts the impingement fluid applicator 164 includes a processing fluid source 166, such as but not limited to a supply of cryogenic impingement fluid, like liquid carbon dioxide. The impingement fluid applicator 164 also includes one or more nozzles 168 (three illustratively depicted) fluidly coupled to the processing fluid source 166 and also coupled to a propellant fluid source 170. Each of the nozzles 168 is internally configured to condense the liquid carbon dioxide into solid snow particles. The nozzles 168 also define respective outlets that are sized for emitting streams 171 of the propellant fluid carrying the solid snow particles from each nozzle 168 to impact against the upright base 102 portion of the supported MBA 120 with a desired impact force suitable for removing contaminants from the MBA 120.

FIG. 6 also diagrammatically depicts the impingement fluid applicator 164 includes a nozzle mover 172 that selectively moves the nozzles 168 in order to laterally move the streams 171 of emitted impingement fluid along a predetermined path. The nozzle mover 172 can move the nozzles 168 in unison or individually, depending on the best sweeping action that results in the desired removal of the contaminants. The impingement fluid applicator 164 can also include a processor-based controller 173 that is programmable to execute computer instructions stored in a memory 175 that define the predetermined path for moving the nozzles 168. The nozzle mover 172 can be an automated end effector that is responsive to the computer instructions to move the nozzles 168.

Figure 7:
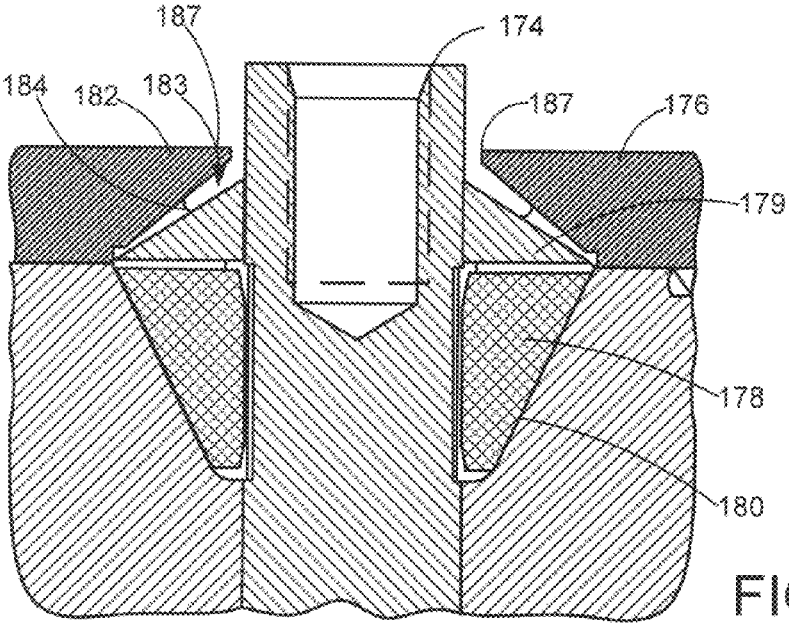
FIG. 7 is a cross sectional view of a portion of the motor of the data storage device of FIG. 1.

It is possible for the impact force generated by the emitted stream 171 to be deleterious to some portions of the MBA 120. For example, FIG. 7 is a cross sectional depiction of the top portion of the motor 106 constructed in the form of a fluid dynamic bearing type of motor. Such a motor has a stationary central shaft 174, around which a huh 176 rotates. The hub 176 is supported in rotation by a fixed cone 178 and a fixed cone seal 179 that are affixed to the stationary shaft 174. The fixed cone 178 and fixed cone seal 179 are configured to operably pump a hydrodynamic fluid into a small gap 180 between mating bearing surfaces of the rotating hub 176 and the fixed cone 178. The hub 176 also forms a rotating seal 182 portion that defines a small gap 183 between the rotating seal 182 and the fixed cone seal 179. Dynamic pressure changes imparted to the hydrodynamic fluid are accommodated by permitting the volume of fluid being pumped to vary by venting the fluid chamber to atmosphere by the open-ended gap 183. Accordingly, the location of the meniscus 184 formed by the hydrodynamic fluid in the gap 183 advantageously varies along the gap 183 in relation to those volumetric changes.

The impact force of the emitted stream 171 (FIG. 6) can deform the thin-pointed-end 187 of the rotating seal 182, adversely altering the gap 183 and damaging the motor 106 beyond its fitness for use. FIG. 5 shows a respective number of shields 188 are employed to deflect the emitted processing fluid stream 171 away from at least the part of the motor 106 that is vulnerable to damage as the stream 171 is moved along the predetermined path.

Figure 8:
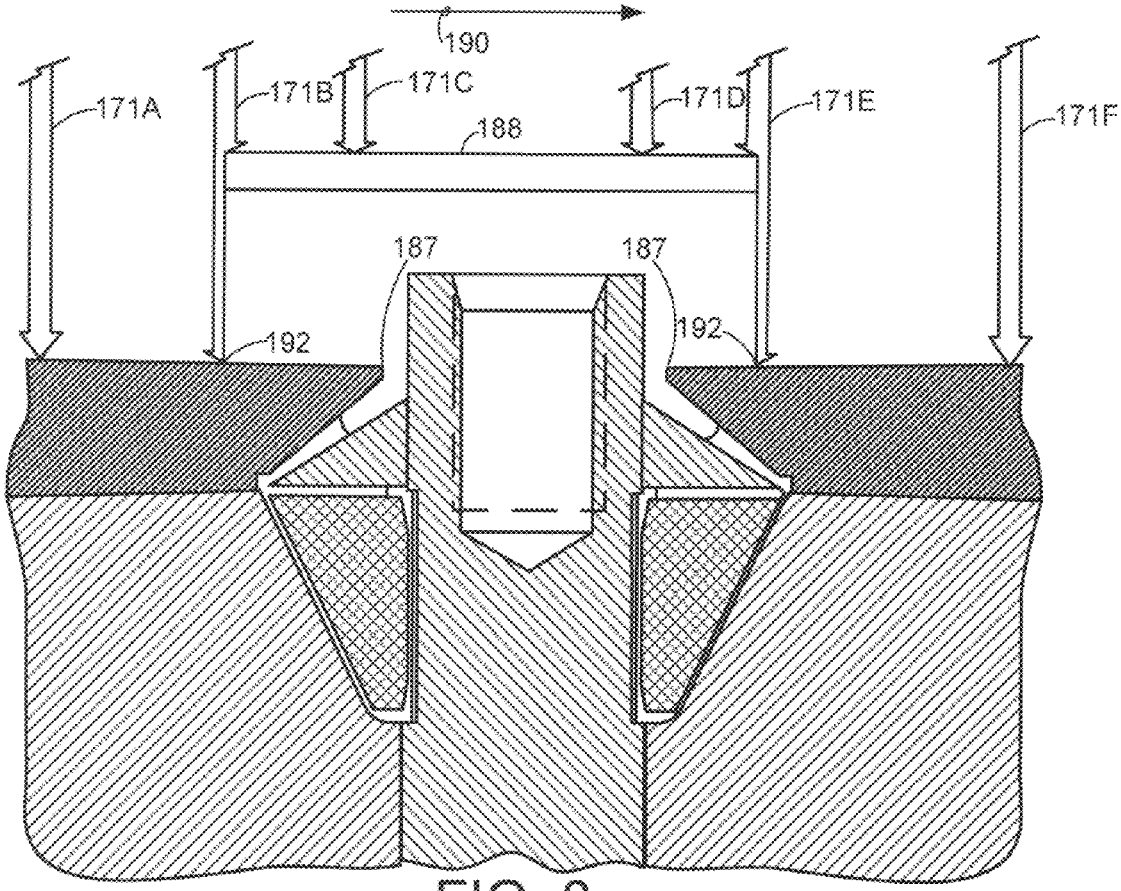
FIG. 8 is a view similar to FIG. 7 with the shield depicted in place to protect the central region of the motor from the stream of impingement fluid.

FIG. 8 is a view similar to that of FIG. 7 but depicting the shield 188 in place to deflect the stream 171 away from the central portion of the motor 106 where it can damage the thin portions of the rotating seal 182. As the stream 171 is moved laterally from left-to-right as indicated by arrow 190, the stream 171 is initially fully impacting the outer portion of the motor 106 at the stream depicted as 171A. As the stream 171 encounters the edge of the shield 188, a portion of stream depicted as 171B impacts the motor 106 and the other portion of the stream 171B is deflected by the shield 188. Deflecting the stream 171 in this manner prevents impingement of the stream 171 against the motor 106 anywhere inside the radius 192 that is aligned with the edge of the shield 188 with respect to the angle with which the stream 171 is sprayed toward the motor 106. As the stream 171 continues along the predetermined path, it is fully deflected away from the motor 106 at the stream depicted by 171C. The streams depicted in 171D, 171E, and 171F repeat this deflection pattern in reverse order.

in this manner the embodiments of the present invention contemplate the cryogenic impingement fluid can be emitted at substantially the same velocity at locations of the predetermined path where no portion of the stream 171 is deflected by the shield 188, such as those locations depicted in FIG. 8 as 171A and 171F, and at a second location of the predetermined path where at least a portion of the stream 171 is deflected by the shield 188, such as those locations depicted in FIG. 8 as 171B, 171C, 171D, and 171E. Continuously emitting the impingement fluid at the optimal velocity for effective cleaning significantly reduces the workpiece processing cycle time for traversing the predetermined path by eliminating the delays associated with building up a desired flow rate of the snow particles after recovering from having reduced the flow rate to prevent damaging the workpiece.

In order to optimize the processing throughput rate, the predetermined path of the nozzle 168 is such that it emits the stream 171 against all the plurality of supported MBAs 120 during each complete processing cycle, and a plurality of shields 188 can be provided to deflect the emitted stream 171 from at least a portion of each of the plurality of MBAs 120 to prevent damaging them.

To further optimize the processing throughput rate the controller 173 (FIG. 6) can be equipped with computational intelligence to recognize processing parameters and select the predetermined path of the nozzles 168 accordingly. For example, the controller 173 can include sensory devices such as proximity switches and the like that indicate how many MBAs 120 are loaded to the fixture 121, and then recall executable instructions for the appropriate predetermined path for that number of MBAs from the memory 175 (FIG. 6). Further, if different MBA models are being processed sequentially, the controller 173 can include other sensory devices like bar code readers or radio-frequency identification receivers to detect model indicia on the MBA 120 or nest block 124 and then recall the appropriate executable instructions for the appropriate predetermined path for that MBA model from the memory 175. In either case, the controller intelligence permits automating the process of identifying the configuration of the workpieces from a plurality of different configurations to accordingly select the corresponding predetermined path with which to move the stream 171 from a plurality of different paths.

Figure 9:
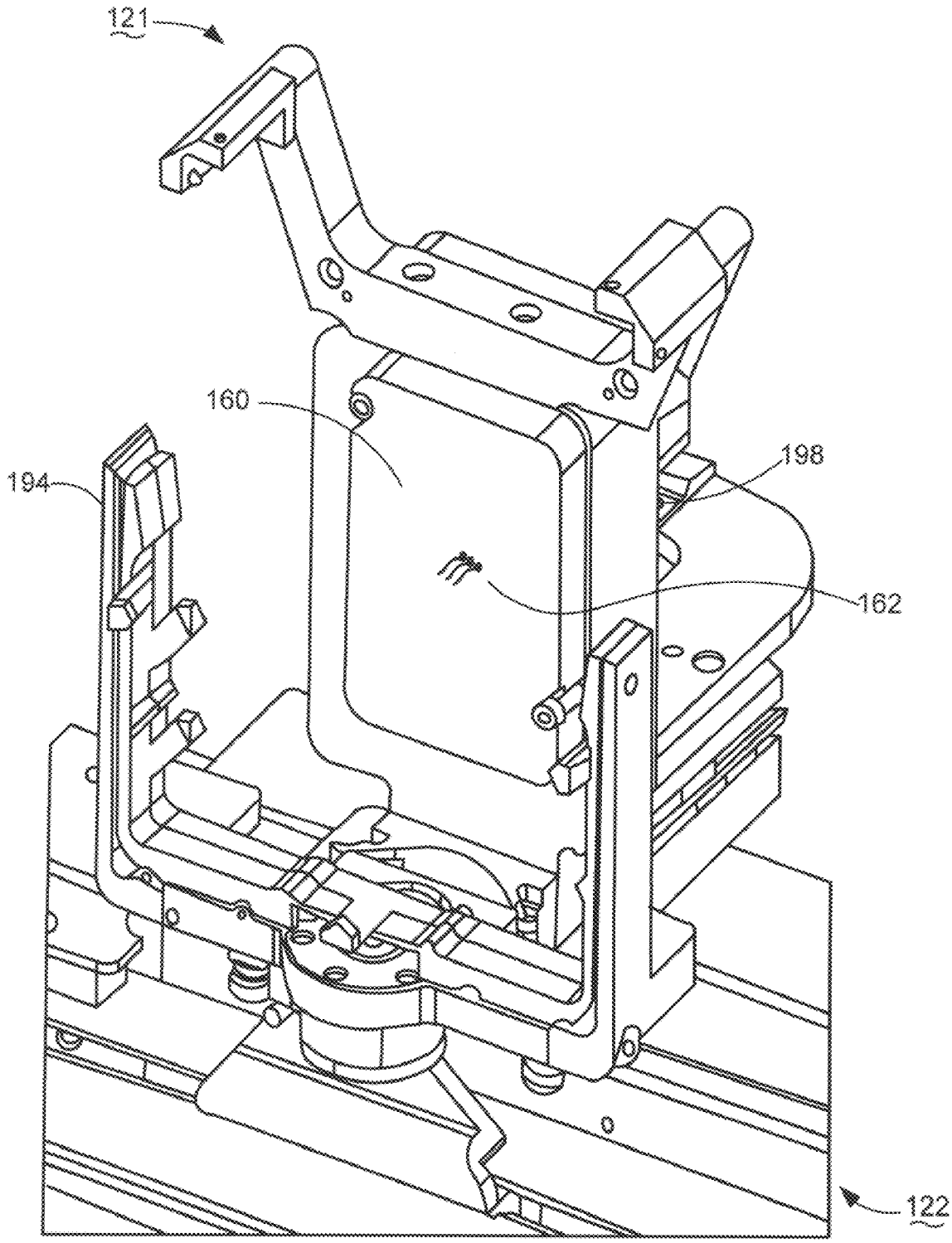
FIG. 9 is an isometric depiction of a fixture constructed in accordance with alternative embodiments of the present invention.
Figure 10:
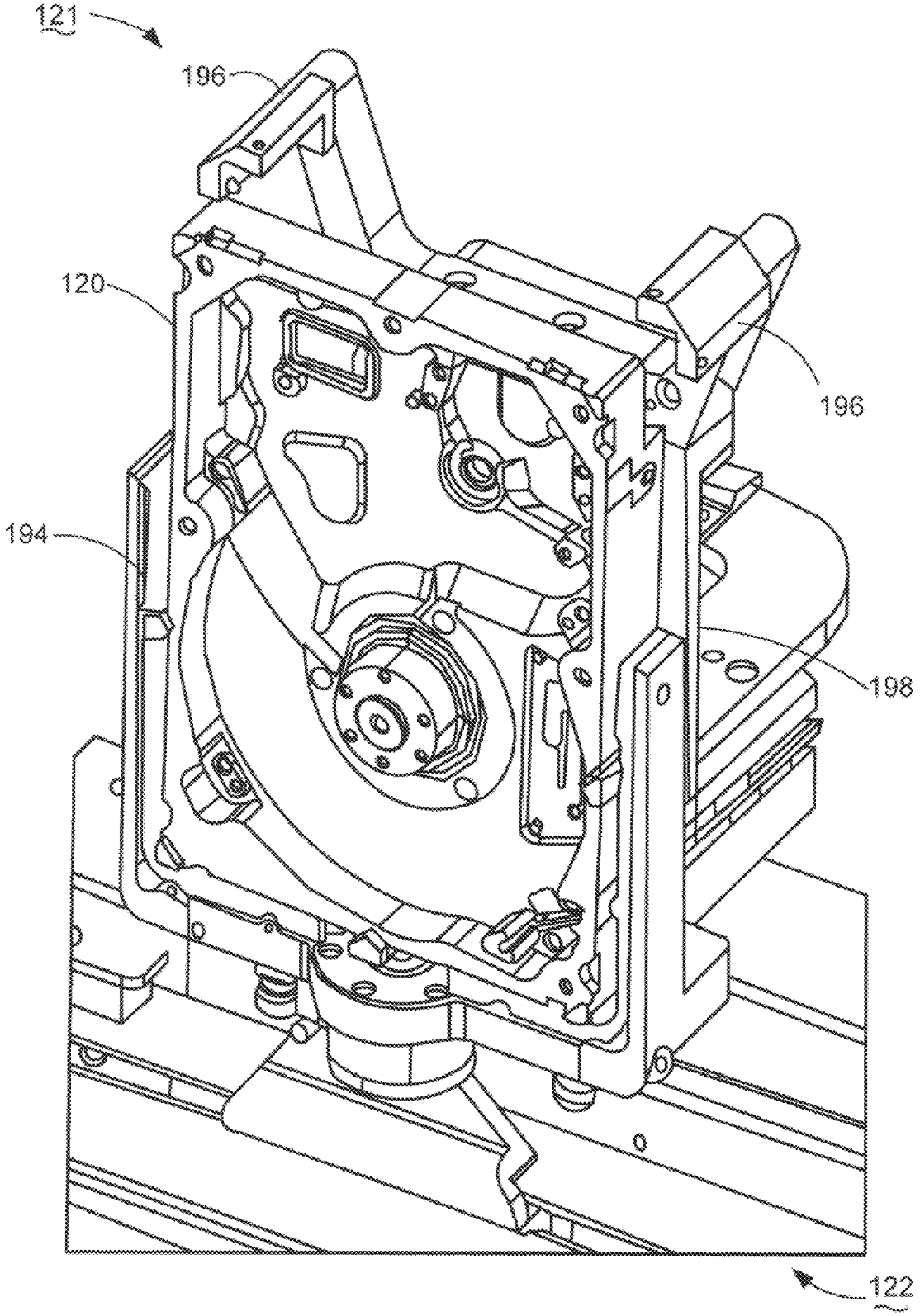
FIG. 10 depicts an MBA loaded to the fixture of FIG. 9.

The present embodiments are not limited to the illustrative embodiments above using the removable nest block 124 to simultaneously process a plurality of the MBAs 120. FIG. 9 depicts alternative equivalent embodiments wherein the apparatus 121 has a support feature either fixed to the framework 122 or removably attachable thereto for supporting only one MBA 120 at a time for processing. These embodiments, like those discussed above, have the framework 122 supporting the modular pin block 160 providing the electrical power source terminating in the electrical connection pins 162. However, unlike the embodiments above, a frame 194 is sized to support only one MBA 120 at a time, as shown disposed in the frame 194 in FIG. 10. After the MBA 120 is inserted into the frame 194, gripping members 196 are selectively moved downward (in the depiction of FIG. 10) by an actuator 198 to grippingly engage the MBA 120 to secure it for processing.

The present embodiments contemplate employing the apparatus described herein in practicing a method for processing an MBA (such as 120). The method includes the step of removably supporting the MBA in a fixture (such as 121) that operably connects the motor (such as 106) of the MBA to a power source (such as 162). That enables the next step of energizing the motor via the power source to rotate the motor at a controlled operational speed. Testing has determined that significantly more contamination is removed from the MBA by spinning the motor at the controlled operational speed while spraying the MBA with the impingement fluid (such as 171). The centrifugal force created by the spinning mass aids in dislodging the contaminants from the motor itself, especially from within recesses formed in the motor. The spinning mass also creates windage in the small clearance between the rotating motor hub and the fixed base 102 that slings contaminants out of that space during processing and prevents the localized high pressure from the stream of impingement fluid from forcing contaminants into the space.

The method further includes, during the energizing step, the step of laterally moving the nozzle (such as 168) coupled to the processing fluid source (such as 166) along the predetermined path so that the stream of the processing fluid emitted from the nozzle impacts against the supported MBA with a desired impact force along the predetermined path. Finally, the method includes deflecting (such as 188) the emitted processing fluid away from at least a part of the supported motor as the stream is moved along the predetermined path.

As described above, the removably supporting step can include the step of attaching the base of the MBA to a nest block (such as 124) and then unitarily attaching the nest block with the base attached thereto to a framework (such as 122). In that case, the energizing step includes electrically connecting the power source to the motor as an automatic result of attaching the nest block with the base attached thereto to the framework.

Generally, an apparatus and associated method is contemplated for treating a workpiece (such as 100) with a cryogenic impingement fluid that includes a fixture (such as 121) for supporting the workpiece in an upright position and operably connecting a motor of the workpiece (such as 106) to a power source (such as 162) in the supported position. A cryogenic impingement fluid applicator (such as 164) sprays a stream of the cryogenic impingement fluid (such as 171) against the supported workpiece and laterally moves the stream in accordance with a predetermined path. A shield (such as 188) deflects the stream of cryogenic impingement fluid to prevent the stream from contacting at least a part of the workpiece (such as 187) as the stream is moved along the predetermined path.

The fixture can include a nest block (such as 124) and a framework (such as 122), the nest block defining a surface (such as 130, 132, 134, 136) sized to provide a mating relationship with the workpiece for receivingly engaging the workpiece for attachment of the nest block and workpiece theretogether, and the nest block with the workpiece attached thereto being unitarily removably attachable to the framework. In that case, the framework can include the power source that matingly aligns with the motor when the nest block with the workpiece attached thereto is attached to the framework.

A plurality of workpieces can be simultaneously attached to the fixture for processing, and the power source matingly aligns with a motor in each of the plurality of workpieces to simultaneously energize all of the motors at a controlled operational speed of the motors during the workpiece processing. The power source can include respective sets of protuberant electrical connection pins depending from the framework that abuttingly engage a connector on each of the motors. The predetermined path can spray the stream of cryogenic impingement fluid against two or more of the plurality of workpieces, with the shield deflecting the stream from at least a portion of each of the two or more of the plurality of workpieces.

The stream of cryogenic impingement fluid can be sprayed at substantially the same velocity at a first location of the predetermined path where no portion of the stream is deflected by the shield and at a second location of the predetermined path where at least a portion of the stream is deflected by the shield.

The cryogenic impingement fluid applicator can execute computer instructions stored in memory (such as 175) to identify the configuration of the one or more workpieces from a plurality of different configurations and accordingly select the corresponding predetermined path with which to move the stream from a plurality of different paths.

The foregoing discussion has been presented for purposes of illustration and description. The foregoing is not intended to limit the embodiments to the form or forms disclosed herein. In the foregoing description for example, various features of the claimed invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of any of the disclosed embodiments. Thus, the following claims are hereby incorporated into this description, with each claim standing on its own as separate embodiments of the invention.

Moreover, though the description of the claimed invention has included a description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, or steps to those claimed, whether or not such alternate, interchangeable and/or equivalent structures, functions, or steps are explicitly disclosed herein, and without intending to publicly dedicate any patentable subject matter.

What is claimed:

1. An apparatus for processing a motor-base assembly (MBA), the apparatus comprising:

a fixture defining a support feature sized for removably supporting the MBA;

a power source supported by the fixture and operably aligned with the supported MBA to selectively supply electrical power to a motor of the MBA;

a processing fluid source;

a nozzle coupled to the processing fluid source and defining an outlet sized for emitting a stream of the processing fluid from the nozzle to impact against the supported MBA with a desired impact force;

a nozzle mover that moves the nozzle in order to laterally move the stream of emitted processing fluid along a predetermined path; and a shield to deflect the stream of emitted processing fluid away from at least a part of the supported MBA as the stream is moved along the predetermined path.

2. The apparatus of claim 1 wherein the support feature comprises a nest block and a framework, the nest block defining a surface sized to provide a mating relationship with the MBA for attaching the MBA to the nest block so that the nest block and MBA are unitarily removably attachable to the framework.

3. The apparatus of claim 2 wherein the framework comprises the power source that electrically connects to the motor when the nest block with the MBA attached thereto is attached to the framework.

4. The apparatus of claim 1 wherein a plurality of MBAs are supported by the support feature, and wherein the power source simultaneously supplies electrical power to the motor in each of the MBAs.

5. The apparatus of claim 4 wherein the power source comprises one or more protuberant electrical connection pins depending from the framework that matingly engage a connector of the supported MBA.

6. The apparatus of claim 5 wherein the protuberant electrical connection pins are supported by a modular pin block that is removably attached to the framework.

7. The apparatus of claim 4 wherein the predetermined path emits the stream of processing fluid against two or more of the plurality of MBAs, and wherein the shield deflects the emitted stream from at least a portion of each of the plurality of MBAs.

8. The apparatus of claim 1 wherein the processing fluid comprises a cryogenic impingement fluid that is emitted at substantially the same velocity at a first location of the predetermined path where no portion of the stream is deflected by the shield and at a second location of the predetermined path where at least a portion of the stream is deflected by the shield.

9. The apparatus of claim 1 wherein the nozzle mover is programmable to execute computer instructions stored in memory that define the predetermined path.

10. A method for processing a motor-base assembly (MBA), comprising:

removably supporting the MBA in a fixture that operably connects a motor of the MBA to a power source;

selectively energizing the motor via the power source to rotate the motor at a controlled operational speed;

during the selectively energizing step, laterally moving a nozzle coupled to a processing fluid source along a predetermined path so that a stream of the processing fluid emitted from the nozzle impacts against the supported MBA with a desired impact force along the predetermined path; and deflecting the stream of emitted processing fluid away from at least a part of the supported MBA as the stream is moved along the predetermined path.

11. The method of claim 10 wherein the removably supporting step comprises attaching the MBA to a nest block and in turn unitarily attaching the nest block with the MBA attached thereto to a framework.

12. The method of claim 11 wherein the selectively energizing step comprises electrically connecting the power source to the motor by aligning a terminal end of the power source with a location of the motor in the MBA after the MBA and nest block are unitarily attached to the framework.

13. An apparatus for treating a workpiece with a cryogenic impingement fluid comprising:

a fixture that supports the workpiece in an upright position and operably connects an electrical component of the workpiece to a power source in the supported position;

a cryogenic impingement fluid applicator that sprays a stream of the cryogenic impingement fluid against the supported workpiece and laterally moves the stream in accordance with a predetermined path; and a shield that deflects the stream of cryogenic impingement fluid to prevent the stream from contacting at least a part of the workpiece as the stream is moved along the predetermined path.

14. The apparatus of claim 13 wherein the fixture comprises a nest block and a framework, the nest block defining a surface sized to provide a mating relationship with the workpiece for receivingly engaging the workpiece for attaching the nest block and workpiece together, and the nest block with the workpiece attached thereto being unitarily removably attachable to the framework.

15. The apparatus of claim 14 wherein the framework comprises the power source that matingly aligns with the electrical component when the nest block with the workpiece attached thereto is unitarily attached to the framework.

16. The apparatus of claim 13 wherein a plurality of workpieces are simultaneously attached to the fixture, and wherein the power source matingly aligns with the respective electrical component in each of the plurality of workpieces to simultaneously energize all of the electrical components at a controlled operational level during processing.

17. The apparatus of claim 16 wherein the power source comprises respective sets of protuberant electrical connection pins depending from the framework that abuttingly engage a connector on each of the electrical components.

18. The apparatus of claim 16 wherein the predetermined path sprays the stream of cryogenic impingement fluid against two or more of the plurality of workpieces, and wherein the shield deflects the stream from at least a portion of each of the two or more of the plurality of workpieces.

19. The apparatus of claim 13 wherein the stream of cryogenic impingement fluid is sprayed at substantially the same velocity at a first location of the predetermined path where no portion of the stream is deflected by the shield and at a second location of the predetermined path where at least a portion of the stream is deflected by the shield.

20. The apparatus of claim 13 wherein the cryogenic impingement fluid applicator executes computer instructions stored in memory to identify the configuration of the workpiece from a plurality of different configurations and accordingly selects the corresponding predetermined path with which to move the stream from a plurality of different paths.

* * * * *

UNITED STATES PATENT AND TRADEMARK OFFICE
Certificate

Patent No. 8,313,579 B2 Patented: November 20, 2012

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Dennis Quinto Cruz, Longmont, CO (US); David Maxwell Harrold, Longmont, CO (US); Grant Nicholas Hester, Longmont, CO (US); Timothy Ronald Brown, Westminster, CO (US); and Hans Geittmann, Longmont, CO (US).

Signed and Sealed this Twelfth Day of February 2013.

MICHAEL BARR
*Supervisory Patent Examiner*
Art Unit 1711
Technology Center 1700